US011391275B2

(12) United States Patent
Tanaka et al.

(10) Patent No.: US 11,391,275 B2
(45) Date of Patent: Jul. 19, 2022

(54) FLUID CONTROL APPARATUS

(71) Applicant: Murata Manufacturing Co., Ltd., Kyoto (JP)

(72) Inventors: Nobuhira Tanaka, Kyoto (JP); Daisuke Kondo, Kyoto (JP); Hiroyuki Yokoi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/943,301

(22) Filed: Jul. 30, 2020

(65) Prior Publication Data

US 2020/0355180 A1 Nov. 12, 2020

Related U.S. Application Data

(63) Continuation of application No. PCT/JP2018/044654, filed on Dec. 5, 2018.

(30) Foreign Application Priority Data

Feb. 16, 2018 (JP) ..... JP2018-025663

(51) Int. Cl.
*F04B 45/047* (2006.01)
*F04B 43/04* (2006.01)
(Continued)

(52) U.S. Cl.
CPC ..... *F04B 45/047* (2013.01); *F04B 17/003* (2013.01); *F04B 43/046* (2013.01); *F04B 49/22* (2013.01)

(58) Field of Classification Search
CPC .... F04B 17/003; F04B 43/046; F04B 45/047; F04B 49/22
See application file for complete search history.

(56) References Cited

U.S. PATENT DOCUMENTS 4,852,608 A 8/1989 Bennitt
2009/0232684 A1* 9/2009 Hirata ..... F04B 43/046 417/413.2
(Continued)

FOREIGN PATENT DOCUMENTS

JP 2012528981 A 11/2012
JP 2015117647 A 6/2015
(Continued)

OTHER PUBLICATIONS

International Search Report issued in Application No. PCT/JP2018/044654, dated Feb. 19, 2019.
(Continued)

*Primary Examiner* — Connor J Tremarche
(74) *Attorney, Agent, or Firm* — Pearne & Gordon LLP

(57) ABSTRACT

A fluid control apparatus includes a valve and a pump. The valve has a valve chamber. The first main plate has a first aperture through which the valve chamber communicates with the outside, and the second main plate has a second aperture through which the valve chamber communicates with the outside. The valve further includes a valve diaphragm disposed inside the valve chamber. The valve diaphragm is configured to switch the communication state. The pump includes a piezoelectric device. The pump has a pump chamber. The pump chamber communicates with the valve chamber through the second aperture. In addition, in flexural vibration of the vibration unit, a frequency coefficient of the first main plate is greater than a frequency coefficient of the second main plate.

12 Claims, 5 Drawing Sheets

(51) Int. Cl.
*F04B 17/00* (2006.01)
*F04B 49/22* (2006.01)

(56) References Cited

U.S. PATENT DOCUMENTS

| | | | | |
|---|---|---|---|---|
| 2013/0071269 | A1* | 3/2013 | Fujisaki | F04B 43/046 417/413.2 |
| 2015/0071797 | A1* | 3/2015 | Takeuchi | F04F 7/00 417/413.2 |
| 2015/0150470 | A1* | 6/2015 | Sano | F04B 43/046 600/498 |
| 2015/0174910 | A1 | 6/2015 | Kaneko | |
| 2017/0138357 | A1* | 5/2017 | Kondo | F04B 49/06 |

FOREIGN PATENT DOCUMENTS

| | | | |
|---|---|---|---|
| JP | 2017072140 | A | 4/2017 |
| WO | 2010/139918 | A1 | 12/2010 |

OTHER PUBLICATIONS

Written Opinion issued in Application No. PCT/JP2018/044654, dated Feb. 19, 2019.

* cited by examiner t1
21
t2
22
P1
t3
331

21
22
P2
331

21
22
P3
331 t1
21
t2
22
P4
t3
331

21
22
P5
331

21
22
P6
331

FLUID CONTROL APPARATUS

This is a continuation of International Application No. PCT/JP2018/044654 filed on Dec. 5, 2018 which claims priority from Japanese Patent Application No. 2018-025663 filed on Feb. 16, 2018. The contents of these applications are incorporated herein by reference in their entireties.

BACKGROUND

Technical Field

The present disclosure relates to a fluid control apparatus for controlling flow rate of fluid.

Various fluid control apparatuses equipped with a driving device, such as a piezoelectric device, have been in practical use.

Patent Document 1 describes a fluid control apparatus having a pump chamber and a valve chamber. The pump chamber is defined by a top plate that also partially defines the valve chamber and by a vibrating plate to which a driving device is directly attached. The top plate and the vibrating plate vibrate in opposite phase, thereby controlling fluid flow.

Patent Document 1: Japanese Unexamined Patent Application Publication (Translation of PCT Application) No. 2012-528981

BRIEF SUMMARY

However, with the structure of the fluid control apparatus according to Patent Document 1, the center of gravity of the fluid control apparatus may oscillate largely.

In addition, in the case of the fluid control apparatus being fixed to an external housing, vibrations may be transmitted to the external housing. This may cause the fixation portion of the fluid control apparatus to become loose, which degrades the performance of the fluid control apparatus.

The present disclosure provides a fluid control apparatus that can reduce oscillation of the center of gravity.

A fluid control apparatus according to the present disclosure includes a valve and a pump. The valve includes a first main plate, a second main plate having one principal surface that opposes one principal surface of the first main plate, and a side plate that connects the first main plate and the second main plate to each other. The valve has a valve chamber surrounded by the first main plate, the second main plate, and the side plate. The first main plate has a first aperture through which the valve chamber communicates with the outside of the valve chamber, and the second main plate has a second aperture through which the valve chamber communicates with the outside of the valve chamber. The valve further includes a valve diaphragm disposed inside the valve chamber. The valve diaphragm is configured to switch between a state in which the first aperture and the second aperture communicate with each other and a state in which the first aperture and the second aperture do not communicate with each other.

The pump includes a vibration unit that has a piezoelectric device and a vibrating plate and is disposed so as to oppose the other principal surface of the second main plate. The pump has a pump chamber that is defined by the vibration unit and the second main plate. The pump chamber communicates with the valve chamber through the second aperture.

In addition, in flexural vibration of the vibration unit, a frequency coefficient of the first main plate is greater than a frequency coefficient of the second main plate.

With this configuration, the first main plate having a greater frequency coefficient is less flexible than the second main plate. Accordingly, the first main plate and the vibration unit vibrate in opposite phase, which counteracts the vibration of the fluid control apparatus caused by the vibration of the vibration unit. As a result, the fluctuation of the center of gravity of the fluid control apparatus is reduced, which improves the reliability of the fluid control apparatus.

A fluid control apparatus according to the present disclosure includes a valve and a pump. The valve includes a first main plate, a second main plate having one principal surface that opposes one principal surface of the first main plate, and a side plate that connects the first main plate and the second main plate to each other. The valve has a valve chamber surrounded by the first main plate, the second main plate, and the side plate. The first main plate has a first aperture through which the valve chamber communicates with the outside of the valve chamber, and the second main plate has a second aperture through which the valve chamber communicates with the outside of the valve chamber. The valve further includes a valve diaphragm disposed inside the valve chamber. The valve diaphragm is configured to switch between a state in which the first aperture and the second aperture communicate with each other and a state in which the first aperture and the second aperture do not communicate with each other.

The pump includes a vibration unit that has a piezoelectric device and a vibrating plate and is disposed so as to oppose the other principal surface of the second main plate. The pump has a pump chamber that is defined by the vibration unit and the second main plate. The pump chamber communicates with the valve chamber through the second aperture.

In addition, the first main plate and the second main plate are made of the same material, and the thickness of the first main plate is greater than the thickness of the second main plate in a direction normal to respective principal surfaces.

With this configuration, the first main plate and the vibration unit vibrate in opposite phase, which counteracts the vibration of the fluid control apparatus caused by the vibration of the vibration unit. This improves the reliability of the fluid control apparatus.

In the fluid control apparatus of the present disclosure, the first main plate and the vibrating plate can displace in opposite phase.

With this configuration, the first main plate and the vibration unit vibrate in opposite phase. The influence of vibration of the first main plate on the center of the gravity of the apparatus counteracts the influence of vibration of the vibration unit on the center of gravity of the apparatus, which improves the reliability of the fluid control apparatus.

In addition, the fluid control apparatus according to the present disclosure can include an external housing to which the valve is fixed by using the first main plate.

With this configuration, the valve is fixed to the external housing, and the valve is not readily detached since the center of gravity of a structure formed of the pump and the valve scarcely oscillates.

The fluid control apparatus of the present disclosure is applied to a medical apparatus.

The performance of the medical apparatus is thereby improved. The medical apparatus is, for example, a sphygmomanometer, a massage machine, an aspirator, a nebulizer, or a device for negative pressure wound therapy.

Accordingly, the present disclosure can provide a reliable fluid control apparatus that can reduce transmission of vibrations caused by the oscillation of the center of gravity of the fluid control apparatus.

DETAILED DESCRIPTION

First Embodiment

Figure 1A:
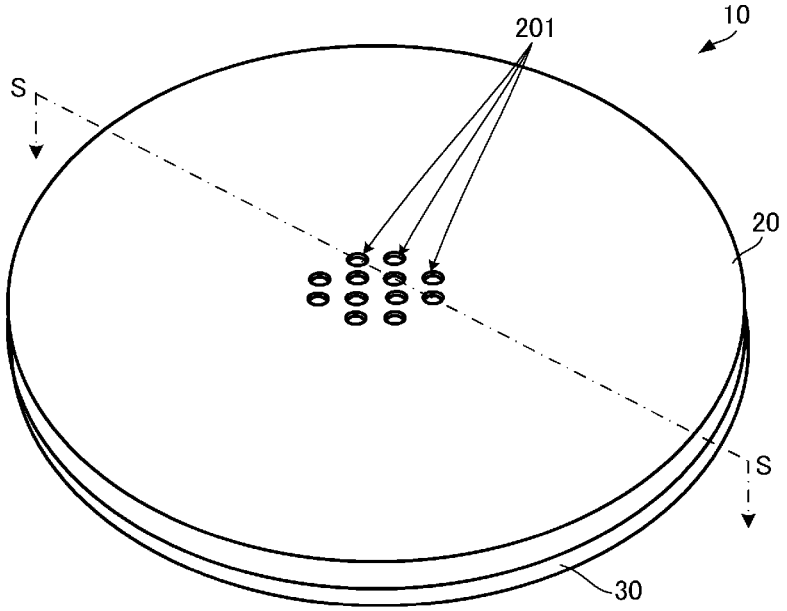
FIG. 1A is a perspective view illustrating the exterior of a fluid control apparatus 10 according to a first embodiment of the present disclosure when the fluid control apparatus 10 is viewed from the side of a valve 20.
Figure 1B:
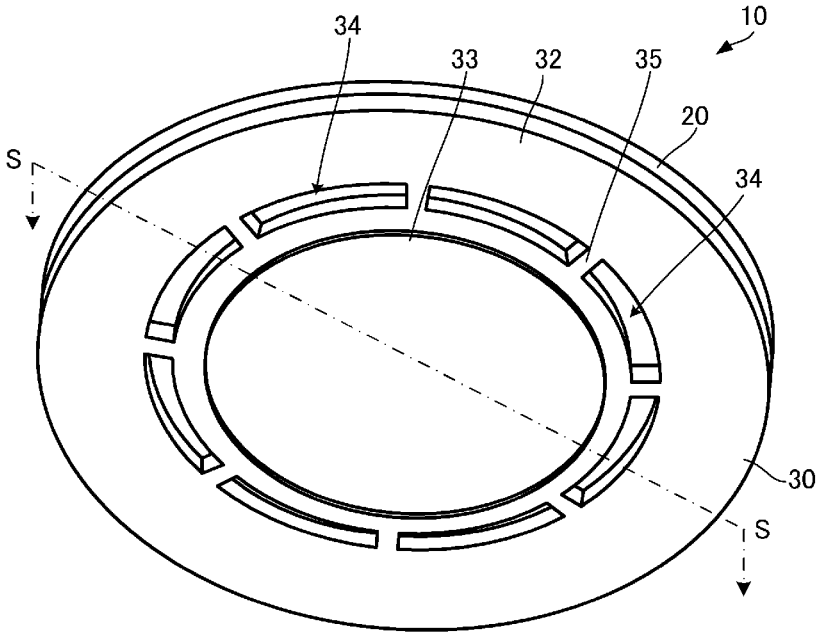
FIG. 1B is a perspective view illustrating the exterior of the fluid control apparatus 10 according to the first embodiment of the present disclosure when the fluid control apparatus 10 is viewed from the side of a pump 30.
Figure 2:
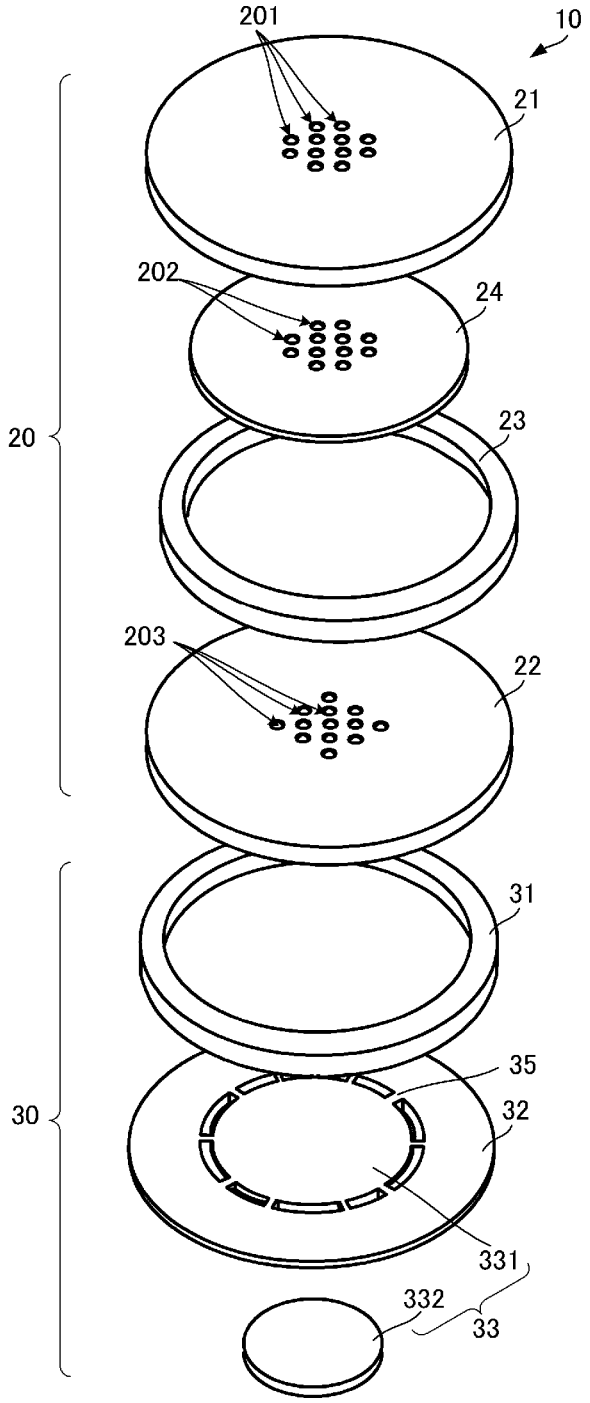
FIG. 2 is an exploded perspective view illustrating the fluid control apparatus 10 according to the first embodiment of the present disclosure.
Figure 3:
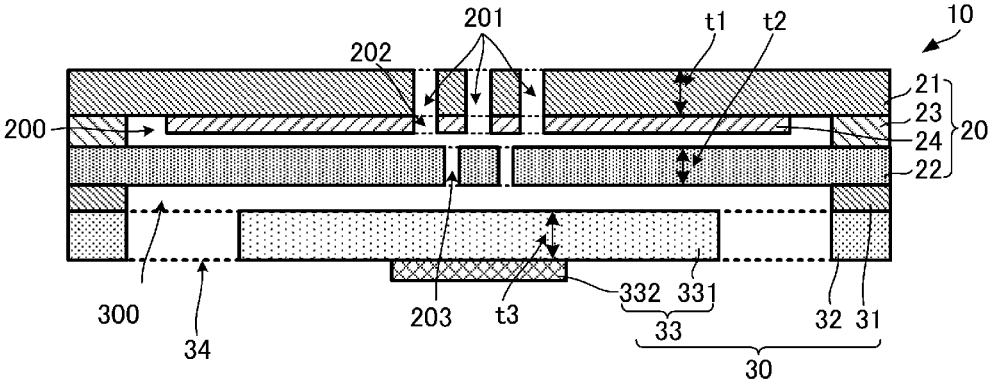
FIG. 3 is a cross-sectional side view illustrating the fluid control apparatus 10 according to the first embodiment of the present disclosure.
Figure 5:
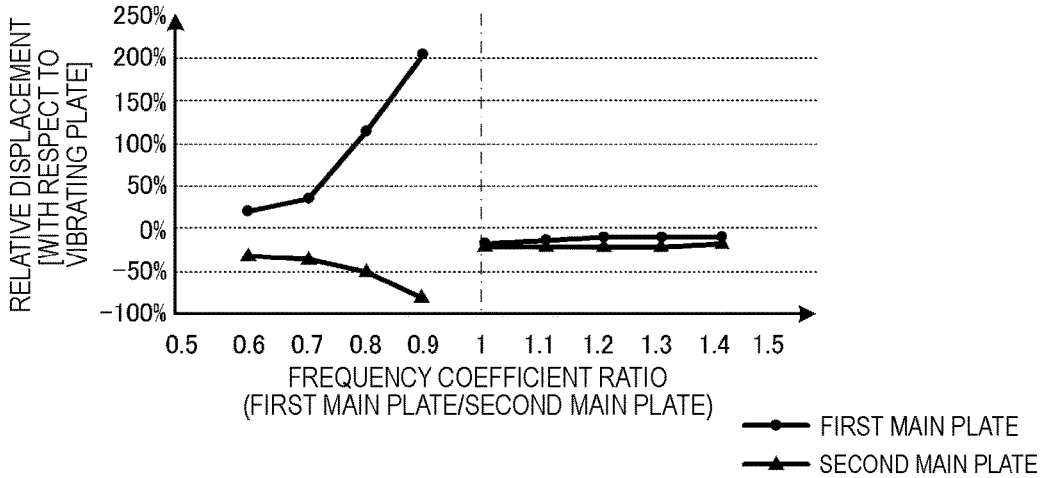
FIG. 5 is a graph depicting displacement percentage with respect to frequency coefficient ratio of the fluid control apparatus 10 according to the first embodiment of the present disclosure.
Figure 6:
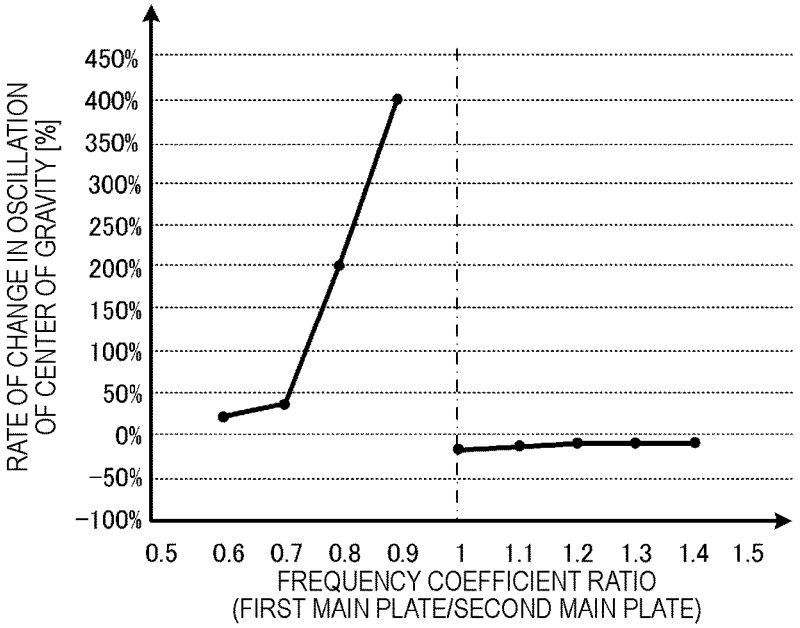
FIG. 6 is a graph depicting rate of change in fluctuation of the center of gravity with respect to frequency coefficient ratio of the fluid control apparatus 10 according to the first embodiment of the present disclosure.
Figure 7:
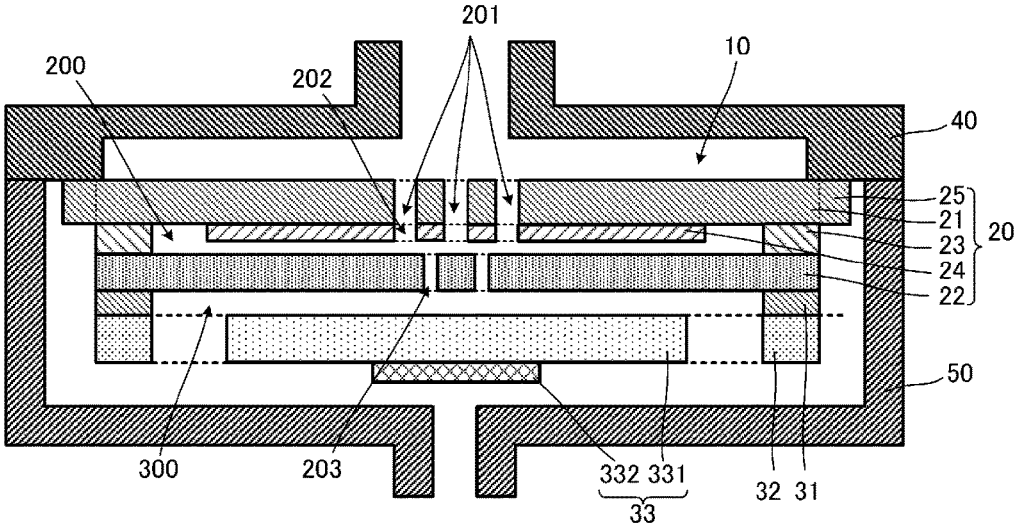
FIG. 7 is a cross-sectional side view illustrating the fluid control apparatus 10 according to the first embodiment of the present disclosure when a structure constituted by a valve 20 and a pump 30 is fixed to an external housing.

A fluid control apparatus according to a first embodiment of the present disclosure will be described with reference to the drawings. FIG. 1A is a perspective view illustrating the exterior of a fluid control apparatus 10 according to the first embodiment of the present disclosure when the fluid control apparatus 10 is viewed from the side of a valve 20. FIG. 1B is a perspective view illustrating the exterior of the fluid control apparatus 10 according to the first embodiment of the present disclosure when the fluid control apparatus 10 is viewed from the side of a pump 30. FIG. 2 is an exploded perspective view illustrating the fluid control apparatus 10 according to the first embodiment of the present disclosure. FIG. 3 is a cross-sectional side view of the fluid control apparatus 10, which is taken along line S-S of FIG. 1A and of FIG. 1B. FIG. 4A to FIG. 4F are cross-sectional side views conceptually illustrating fluctuation of the center of gravity of the fluid control apparatus 10 according to the first embodiment of the present disclosure. FIG. 5 is a graph depicting relative displacement with respect to frequency coefficient ratio of the fluid control apparatus 10 according to the first embodiment of the present disclosure. FIG. 6 is a graph depicting rate of change in fluctuation of the center of gravity with respect to frequency coefficient ratio of the fluid control apparatus 10 according to the first embodiment of the present disclosure. FIG. 7 is a cross-sectional side view illustrating the fluid control apparatus 10 according to the first embodiment of the present disclosure when a structure formed of a valve 20 and a pump 30 is fixed to an external housing. Note that some reference signs are omitted and part of a structure is exaggerated for the purpose of easy recognition.

As illustrated in FIGS. 1A, 1B, 2, and 3, the fluid control apparatus 10 includes a valve 20 and a pump 30. The valve 20 has multiple first apertures 201 that open at a top surface of the valve 20. The first apertures 201 are ventholes.

A structure of the valve 20 will be described first. The valve 20 includes a first main plate 21, a second main plate 22, a side plate 23, and a valve diaphragm 24. Note that a thickness t1 of the first main plate 21 is greater than a thickness t2 of the second main plate 22.

As illustrated in FIGS. 1A, 2, and 3, the first main plate 21 and the second main plate 22 are shaped like discs. The side plate 23 is shaped like a cylinder.

The side plate 23 is disposed between the first main plate 21 and the second main plate 22 and connects these plates to each other so as to enable the first main plate 21 and the second main plate 22 to oppose each other. More specifically, the center of the first main plate 21 and the center of the second main plate 22 coincide with each other as viewed in plan. The side plate 23 connects outer peripheral regions of the first main plate 21 and the second main plate 22, which are disposed as described above, along the entire circumferences.

According to this configuration, the valve 20 has a valve chamber 200 that is a columnar space surrounded by the first main plate 21, the second main plate 22, and the side plate 23. Note that the side plate 23 may be integrally formed with the first main plate 21 or with the second main plate 22. In this case, the first main plate 21 or the second main plate 22 may be shaped like a recess.

The valve diaphragm 24 is disposed inside the valve chamber 200.

As described, the first main plate 21 has the first apertures 201 that are formed so as to penetrate the first main plate 21. The valve diaphragm 24 also has multiple second apertures 202 that are formed so as to penetrate the valve diaphragm 24 at the same positions as the first apertures 201 as viewed in plan.

Moreover, the second main plate 22 has multiple third apertures 203 that are formed so as to penetrate the second main plate 22. The third apertures 203, however, are formed so as not to overlap the first apertures 201 nor the second apertures 202 as viewed in plan. The valve chamber 200 of the valve 20 communicates with a pump chamber 300 of the pump 30 through the third apertures 203.

Next, a structure of the pump 30 will be described. As illustrated in FIGS. 1B, 2, and 3, the second main plate 22 also serves as a component of the pump 30. The pump 30 is formed of the second main plate 22, a pump side plate 31, a pump bottom plate 32, and a vibration unit 33. The vibration unit 33 is formed of a vibrating plate 331 and a piezoelectric device 332. The vibrating plate 331 has a thickness t3.

In addition, the pump bottom plate 32 is formed integrally with the vibrating plate 331. More specifically, when the pump 30 is viewed from the second main plate 22, the pump bottom plate 32 and the vibrating plate 331 are connected by connection portions 35 so as to be flush with each other. In other words, the pump bottom plate 32 has multiple pump bottom apertures 34 with a predetermined opening width at positions arranged along the outer periphery of the pump bottom plate 32, and the pump bottom apertures 34 separates the vibrating plate 331 from the pump bottom plate 32. With this configuration, the pump bottom plate 32 holds the vibrating plate 331 so as to enable the vibrating plate 331 to vibrate.

The pump side plate 31 is shaped like a ring as viewed from the first main plate 21. The pump side plate 31 is disposed between the second main plate 22 and the pump bottom plate 32 and connects these plates to each other. More specifically, the center of the second main plate 22 and the center of the pump bottom plate 32 coincide with each other. The pump side plate 31 connects outer peripheral regions of the second main plate 22 and the pump bottom plate 32, which are disposed as described above, along the entire circumferences.

According to this configuration, the pump 30 has a pump chamber 300 that is a columnar space surrounded by the second main plate 22, the pump bottom plate 32, and the pump side plate 31.

The piezoelectric device 332 is constituted by a disc-like piezoelectric member and electrodes for driving the piezoelectric member. The electrodes are formed on respective principal surfaces of the disk-like piezoelectric member.

The piezoelectric device 332 is disposed on a surface of the vibrating plate 331 that is opposite to the surface facing the pump chamber 300, in other words, disposed on the outside surface of the pump 30. The center of the piezoelectric device 332 and the center of the vibrating plate 331 substantially coincide with each other as viewed in plan.

The piezoelectric device 332 is coupled to a control unit (not illustrated). The control unit generates drive signals and applies them to the piezoelectric device 332. The drive signals displaces the piezoelectric device 332, and the displacement generates stresses in the vibrating plate 331. This causes the vibrating plate 331 to vibrate flexurally. For example, the vibration of the vibrating plate 331 produces a wave form of Bessel function of the first kind.

The flexural vibration of the vibrating plate 331 (i.e., vibration unit 33) changes the volume and the pressure of the pump chamber 300. Accordingly, a fluid drawn in through the pump bottom apertures 34 is discharged through the third apertures 203.

With the above configuration of the valve 20, the fluid flowing in through the third apertures 203 moves the valve diaphragm 24 toward the first main plate 21. As a result, the fluid is discharged out through the second apertures 202 and the first apertures 201. On the other hand, if the fluid tries to flow from the third apertures 203 to the pump bottom apertures 34, the fluid moves the valve diaphragm 24 toward the second main plate 22, and the valve diaphragm 24 thereby plugs the third apertures 203. Accordingly, the fluid control apparatus 10 serves to rectify fluid flow.

Note that the first main plate 21 and the second main plate 22 are made of such a material and a thicknesses that enable the first main plate 21 and the second main plate 22 to vibrate in a direction normal to the principal surfaces. For example, the material of the first main plate 21 and the second main plate 22 is a stainless steel.

The first main plate 21 and the second main plate 22 will be compared below by using frequency coefficients obtained from a specific formula in a condition where the thickness t1 of the first main plate 21 >the thickness t2 of the second main plate 22 according to the present embodiment. The frequency coefficient is a coefficient representing flexibility of the first main plate 21 and the second main plate 22 that vibrate. More specifically, the frequency coefficient is expressed in the following formula, where in a vibrating plate, t is the thickness of the plate, E is the modulus of longitudinal elasticity (i.e., Young's modulus) of the plate, and ρ is the material density of the plate.

$$\text{frequency coefficient} = t \times \sqrt{\frac{E}{\rho}} \quad \text{[Math. 1]}$$

When the material of the first main plate 21 is the same as that of the second main plate 22, a frequency coefficient F1 of the first main plate 21 is greater than a frequency coefficient F2 of the second main plate 22 since the thickness t1 of the first main plate 21 is greater than the thickness t2 of the second main plate 22. In other words, the first main plate 21 is less flexible than the second main plate 22.

FIGS. 4A to 4F are cross-sectional side views of the fluid control apparatus 10 conceptually depicting fluctuation of the center of gravity of the fluid control apparatus 10. In FIGS. 4A to 4F, t1 denotes the thickness of the first main plate 21, and t2 denotes the thickness of the second main plate 22. Note that positions of the center of gravity are only for example.

Figures 4A, 4B, 4C, 4D, 4E, 4F:
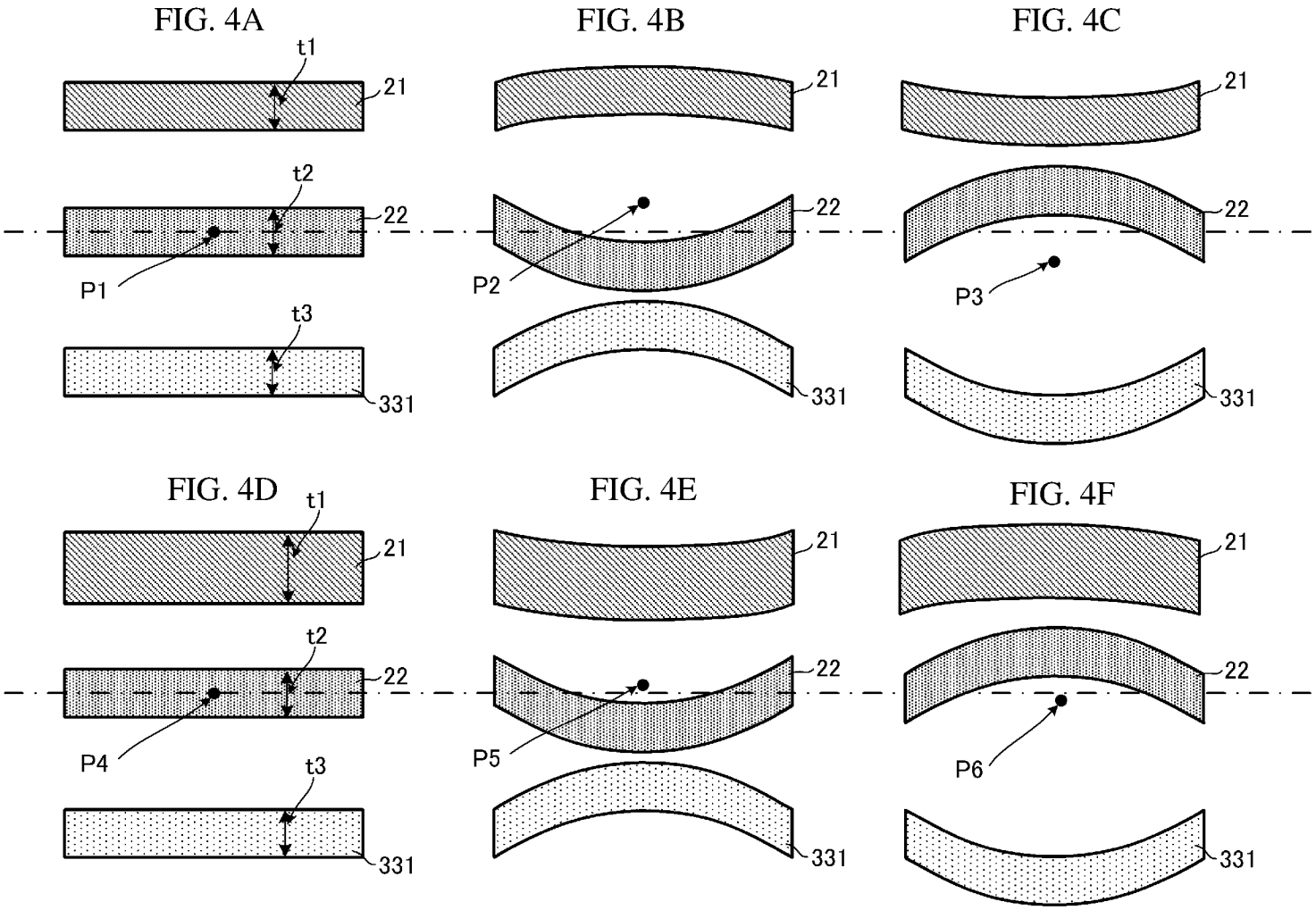
FIG. 4A to FIG. 4F are cross-sectional side views conceptually illustrating oscillation of center of gravity of the fluid control apparatus 10 according to the first embodiment of the present disclosure.

FIGS. 4A to 4C are conceptual illustrations depicting the fluctuation in a fluid control apparatus having a known configuration. In this case, the thickness t1 of the first main plate 21 is equal to the thickness t2 of the second main plate 22.

On the other hand, FIGS. 4D to 4F are conceptual illustrations depicting the fluctuation in the fluid control apparatus according to the present embodiment. In this case, the thickness t1 of the first main plate 21 is greater than the thickness t2 of the second main plate 22.

In FIGS. 4A to 4F, some elements and some reference signs are omitted, and the state of vibration is exaggerated for the purpose of clear understanding.

To begin with, fluctuation of the center of gravity of the fluid control apparatus 10 will be described schematically in the case of the fluid control apparatus 10 having a known configuration. FIG. 4A is a conceptual illustration of the fluid control apparatus 10 when the fluid control apparatus 10 stops. In this case, the center of gravity of the fluid control apparatus 10 is denoted by P1.

FIG. 4B is a conceptual illustration of the fluid control apparatus 10 when the fluid control apparatus 10 draws a fluid. In this case, the center of gravity of the fluid control apparatus 10, which is denoted by P2, is largely shifted toward the first main plate 21.

FIG. 4C is a conceptual illustration of the fluid control apparatus 10 when the fluid control apparatus 10 discharges the fluid. In this case, the center of gravity of the fluid control apparatus 10, which is denoted by P3, is largely shifted toward the second main plate 22.

In the fluid control apparatus 10 with the known configuration, the center of gravity P2 shifts largely toward the first main plate 21, while the center of gravity P3 shifts largely toward the second main plate 22, with respect to the center of gravity P1, which is the position when the fluid control apparatus 10 stops (as is the case in FIG. 4A).

Next, fluctuation of the center of gravity of the fluid control apparatus 10 according to the present embodiment will be described schematically. FIG. 4D is a conceptual illustration of the fluid control apparatus 10 when the fluid control apparatus 10 stops.

In this case, the center of gravity of the fluid control apparatus 10 is denoted by P4.

FIG. 4E is a conceptual illustration of the fluid control apparatus 10 when the fluid control apparatus 10 draws a fluid. In this case, the center of gravity of the fluid control apparatus 10, which is denoted by P5, is located substantially at the same position as the center of gravity P4.

FIG. 4F is a conceptual illustration of the fluid control apparatus 10 when the fluid control apparatus 10 discharges the fluid. In this case, the center of gravity of the fluid control apparatus 10, which is denoted by P6, is located substantially at the same position as the center of gravity P4.

In the case of the fluid control apparatus 10 according to the present embodiment, the center of gravity P5 and the center of gravity P6 are located substantially at the same position as the center of gravity P4, which is the position when the fluid control apparatus 10 stops (as is the case in FIG. 4D).

Accordingly, when the fluid control apparatus 10 vibrates, the center of gravity is caused to stay substantially at the same position by setting the thickness t1 of the first main plate 21 to be greater than the thickness t2 of the second main plate 22. In other words, the center of gravity is caused to stay substantially at the same position by setting a frequency coefficient F1 to be greater than a frequency coefficient F2. A large oscillation of the center of gravity is thereby suppressed. In the case of a structure formed of the valve 20 and the pump 30 being mounted on another member, stress is generated at the mounting portion due to the fluctuation of the center of gravity. However, with this configuration, the stress can be reduced. Thus, the reliability of the fluid control apparatus 10 is improved.

FIG. 5 is a graph depicting simulation results of displacement percentage with respect to frequency coefficient ratio in the fluid control apparatus 10.

In the case illustrated in FIG. 5, the thickness t2 of the second main plate 22 is set to be 0.5 mm, and the thickness t3 of the vibrating plate 331 is set to be 0.4 mm. The thickness t1 of the first main plate 21 is varied in a range between 0.3 mm and 0.7 mm.

The transverse axis represents frequency coefficient ratio. The frequency coefficient ratio is obtained from the following formula: (frequency coefficient of first main plate 21)/(frequency coefficient of second main plate 22). The vertical axis represents relative displacement. The relative displacement of the first main plate 21 and the relative displacement of the second main plate 22 are expressed as the displacement relative to the vibrating plate 331.

When the relative displacement is 0% or more, the first main plate 21 displaces in phase with the vibrating plate 331. When the relative displacement is less than 0%, the first main plate 21 displaces in opposite phase to the vibrating plate 331.

When thickness t1 of first main plate 21<thickness t2 of second main plate 22, the first main plate 21 and the vibrating plate 331 vibrate in phase. When thickness t1 of first main plate 21 thickness t2 of second main plate 22, the first main plate 21 and the vibrating plate 331 vibrate in opposite phase.

In other words, in the condition where thickness t1 of first main plate 21>thickness t2 of second main plate 22, the vibration of the first main plate 21 and the vibration of the vibrating plate 331 are in opposite phase.

Note that the oscillation of the center of gravity can be reduced when the phase difference θ is in a range of 120°<θ<240°. In the case of the phase difference θ being in a range of 152°<θ<208°, the amplitude of the oscillation of the center of gravity can be reduced by half.

The phase difference θ can be measured, for example, by a displacement meter employing the laser Doppler method. In this case, the external housing to which the fluid control apparatus 10 is fixed may be perforated to enable laser light to enter and illuminate measurement targets. The measurement targets are, for example, the surface of piezoelectric device 332 of the vibrating plate 331 and the surface of the first main plate 21 near the perforated hole. Even if the external housing is perforated for measurement, the state of vibration is not affected.

Next, the graph of FIG. 6 will be explained based on the results illustrated in FIG. 5. FIG. 6 is a graph showing simulation results of rate of change in fluctuation of the center of gravity with respect to frequency coefficient ratio in the fluid control apparatus 10.

In the case illustrated in FIG. 6, the thickness t2 of the second main plate 22 is set to be 0.5 mm, and the thickness t3 of the vibrating plate 331 is set to be 0.4 mm. The thickness t1 of the first main plate 21 is varied in a range between 0.3 mm and 0.7 mm.

The transverse axis represents frequency coefficient ratio. The frequency coefficient ratio is obtained from the following formula: (frequency coefficient of first main plate 21)/(frequency coefficient of second main plate 22). The vertical axis represents rate of change in oscillation of the center of gravity. The rate of change in fluctuation of the center of gravity represents how the vibrations of the first main plate 21 and the second main plate 22 counteract the vibration of the vibrating plate 331.

The following explains how the rate of change in oscillation of the center of gravity is calculated. The rate of change in oscillation of the center of gravity is expressed in the equation below, where t1 is the thickness of the first main plate 21, t2 is the thickness of the second main plate 22, t3 is the thickness of the vibrating plate 331, ρ1 is the material density of the first main plate 21, ρ2 is the material density of the second main plate 22, ρ3 is the material density of the vibrating plate 331, A1 is the center displacement amplitude of the first main plate 21, A2 is the center displacement amplitude of the second main plate 22, and A3 is the center displacement amplitude of the vibrating plate 331. In this case, the material density ρ1 of the first main plate 21 is equal to the material density ρ2 of the second main plate 22 and is also equal to the material density ρ3 of the vibrating plate 331.

[Math. 2]

$$\text{rate of change in fluctuation of the center of gravity}=((t1\times\rho1\times A1)+(t2\times\rho2\times A2)+(t3\times\rho3\times A3))/(t3\times\rho3\times A3)$$

The center displacement amplitude A1 of the first main plate 21, the center displacement amplitude A2 of the second main plate 22, and the center displacement amplitude A3 of the vibrating plate 331 take positive values when the corresponding vibrations are in phase with the vibration of the vibrating plate 331. The center displacement amplitude A1 of the first main plate 21, the center displacement amplitude A2 of the second main plate 22, and the center displacement amplitude A3 of the vibrating plate 331 take negative values when the corresponding vibrations are in opposite phase to the vibration of the vibrating plate 331.

In other words, when the rate of change in oscillation of the center of gravity takes a positive value, the first main plate 21 and the second main plate 22 amplify the oscillation of the center of gravity. Conversely, when the rate of change in oscillation of the center of gravity takes a negative value, the first main plate 21 and the second main plate 22 attenuate the oscillation of the center of gravity.

Accordingly, as illustrated in FIG. 6, when thickness t1 of first main plate 21<thickness t2 of second main plate 22, the rate of change in oscillation of the center of gravity takes a positive value, and the oscillation of the center of gravity is amplified. On the other hand, when thickness t1 of the first main plate 21 thickness t2 of second main plate 22, the rate of change in oscillation of the center of gravity takes a negative value, and the oscillation of the center of gravity is attenuated.

Thus, the oscillation of the center of gravity of the fluid control apparatus 10 is attenuated by setting the thickness t1 of the first main plate 21 to be equal to or greater than the thickness t2 of the second main plate 22, which improves the reliability of the fluid control apparatus 10.

In the case of the fluid control apparatus 10 having an external housing, the fluid control apparatus 10 may have, for example, the following configuration. FIG. 7 is a cross-sectional side view illustrating the fluid control apparatus according to the present embodiment when a structure formed of a valve 20 and a pump 30 is fixed to an external housing.

The first main plate 21 has an extension portion 25 that is extended therefrom. For example, the fluid control apparatus 10 is fixed to a first external housing 40 via the extension portion 25 by using adhesion, screw fixation, interlocking, or the like. The external housing is formed of the first external housing 40 and a second external housing 50 that is disposed so as to abut the first external housing 40 and surround the structure.

In other words, the structure of the fluid control apparatus 10 is disposed in the space defined by the first external housing 40 and the second external housing 50.

As described, the oscillation of the center of gravity of the fluid control apparatus 10 is attenuated by setting the thickness t1 of the first main plate 21 to be equal to or greater than the thickness t2 of the second main plate 22. As a result, even if the first main plate 21 is fixed to the first external housing 40, the influence of the oscillation of the center of gravity on the extension portion 25, in other words, which is the portion fixed to the external housing, can be reduced.

In the above description, the structure is fixed to the first external housing 40. The second main plate 22 of the structure may be fixed to the first external housing 40. Note that the reliability is improved more in the case of the first main plate 21 of the structure being fixed to the first external housing 40 since the vibration amplitude of the first main plate 21 is smaller than that of the second main plate 22.

The external housing is described, by way of example, as being formed of the first external housing 40 and the second external housing 50. However, the external housing may be formed integrally or formed of three or more housing parts. The external housing is not limited to these configurations. It is sufficient that the external housing has a shape to which the structure can be fixed.

The shapes of the valve 20 and the pump 30 of the fluid control apparatus 10 have been described as substantially disc-like shapes. However, the shapes of the valve 20 and the pump 30 of the fluid control apparatus 10 are not limited to the disc-like shapes but may be polygon-like shapes.

In addition, the first main plate 21 and the second main plate 22 have been described as being made of the same material, for example, a stainless steel. However, the material of the first main plate 21 and the material of second main plate 22 need not be the same. A different material may be used insofar as the material provides the first main plate 21 with flexibility and with the frequency coefficient greater than that of the second main plate 22. The same advantageous effects can be thereby obtained.

The above-described fluid control apparatus is applied, for example, to a medical apparatus, such as a sphygmomanometer, a massage machine, an aspirator, a nebulizer, or a device for negative pressure wound therapy. The fluid control apparatus can improve efficiency of such a medical apparatus.

Note that in the above, the first main plate and the second main plate have been described as flat plates having uniform thicknesses. However, in the case of the first main plate and the second main plate each having uneven thickness, the average thickness of the first main plate and the average thickness of the second main plate can be compared and be set so as to satisfy the following inequality: average thickness t1*a* of first main plate 21>average thickness t2*a* of second main plate 22.

REFERENCE SIGNS LIST

A1, A2, A3 center displacement amplitude
F1, F2 frequency coefficient
P1, P2, P3, P4, P5, P6 center of gravity
t1, t2, t3 thickness
10 fluid control apparatus
20 valve
21 first main plate
22 second main plate
23 side plate
24 valve diaphragm
25 extension portion
30 pump
31 pump side plate
32 pump bottom plate
33 vibration unit
34 pump bottom aperture
35 connection portion
40 first external housing
50 second external housing
200 valve chamber
201 first aperture
202 second aperture
203 third aperture
300 pump chamber
331 vibrating plate
332 piezoelectric device

The invention claimed is:

1. A fluid control apparatus, comprising:

a valve including:

a first main plate, a second main plate having one principal surface that opposes one principal surface of the first main plate, a side plate that connects the first main plate and the second main plate to each other, a valve chamber surrounded by the first main plate, the second main plate, and the side plate, the first main plate having a first aperture through which the valve chamber communicates with outside of the valve chamber, the second main plate having a second aperture through which the valve chamber communicates with outside of the valve chamber, and a valve diaphragm disposed inside the valve chamber, the valve diaphragm being configured to switch between a state to communicate the first aperture and the second aperture with each other and a state to not communicate the first aperture and the second aperture with each other; and a pump including:

a vibration unit that has a piezoelectric device and a vibrating plate and is disposed so as to oppose the other principal surface of the second main plate, and a pump chamber that is defined by the vibration unit and the second main plate, the pump chamber communicating with the valve chamber through the second aperture, wherein in flexural vibration of the vibration unit, a frequency coefficient of the first main plate is greater than a frequency coefficient of the second main plate.

2. The fluid control apparatus, according to claim 1, wherein:

the first main plate and the second main plate are made of the same material, and a thickness of the first main plate is greater than a thickness of the second main plate in a direction normal to respective principal surfaces.

3. The fluid control apparatus according to claim 1, wherein the first main plate and the vibrating plate displace in opposite phase.

4. The fluid control apparatus according to claim 1, further comprising:

an external housing to which the valve is fixed by using the first main plate.

5. A medical apparatus comprising the fluid control apparatus according to claim 1.

6. The fluid control apparatus according to claim 2, wherein the first main plate and the vibrating plate displace in opposite phase.

7. The fluid control apparatus according to claim 2, further comprising:

an external housing to which the valve is fixed by using the first main plate.

8. The fluid control apparatus according to claim 3, further comprising:

an external housing to which the valve is fixed by using the first main plate.

9. A medical apparatus comprising the fluid control apparatus according to claim 2.

10. A medical apparatus comprising the fluid control apparatus according to claim 3.

11. A medical apparatus comprising the fluid control apparatus according to claim 4.

12. The fluid control apparatus according to claim 6, further comprising:

an external housing to which the valve is fixed by using the first main plate.

* * * * *